United States Patent [19]

Hartshorn

[11] 4,077,785

[45] Mar. 7, 1978

[54] CORROSION RESISTANT ELECTROSTATIC PRECIPITATOR

[75] Inventor: Wayne T. Hartshorn, Sommerville, N.J.

[73] Assignee: Research-Cottrell, Inc., Bound Brook, N.J.

[21] Appl. No.: 795,070

[22] Filed: May 9, 1977

[51] Int. Cl.[2] ..... B03C 3/02

[52] U.S. Cl. ..... 55/155; 55/DIG. 38

[58] Field of Search ..... 55/131, 154–157, 55/DIG. 38

[56] References Cited

U.S. PATENT DOCUMENTS

| | | | |
|---|---|---|---|
| 2,114,682 | 4/1938 | Gumaer | 55/DIG. 38 |
| 3,750,373 | 8/1973 | Olson | 55/155 |
| 3,918,939 | 11/1975 | Hardt | 55/155 |

*Primary Examiner*—Bernard Nozick
*Attorney, Agent, or Firm*—Paul & Paul

[57] ABSTRACT

A corrosion resistant electrostatic precipitator has an array of tubular collector electrodes with a cylindrical casing, the tubular collector electrodes and casing each having a surface resistivity of the order $10^6$ ohms. The walls of the collector tubes, in preferred form, are a lamina comprising, in order from the inner surface outwardly, an innermost resin impregnated with graphite followed by a conductive metal mesh, another layer of resin impregnated with graphite, a fiberglass veil (corrosion resistant barrier), a layer of fiberglass mat, a layer of fiberglass roving, another layer of fiberglass mat, another layer of fiberglass roving, and finally an outer layer of fiberglass mat. The wall of the cylindrical casing is also a lamina whose make-up is generally similar but not identical to the walls of the collector tubes. Means are provided for grounding the conductive metal mesh which is embedded in the collector walls and in the casing wall. In a preferred form, the metal mesh in the walls of the collector tubes is a 2-inch wide band wound helically on 6-inch centers, while the helically wound mesh in the wall of the casing is on 12-inch centers.

11 Claims, 3 Drawing Figures

CORROSION RESISTANT ELECTROSTATIC PRECIPITATOR

BACKGROUND OF THE INVENTION

Corrosion resistant or acid mist electrostatic precipitators comprise an outer shell or casing which supports an array of tubular collecting electrodes forming a plurality of passages through which the gas streams flow. Located on the center axis of each collecting electrode tube is a corona discharge electrode whose function is to impart an electric charge to the mist. The charged particles are attracted to the collecting electrode. In the case of an acid mist precipitator, at least some of the collection is free-flowing particulate which will flow by gravity down the inner wall of the tube. Auxiliary flushing or flooding may be provided.

For many years, because lead is corrosion resistant, acid mist electrostatic precipitators were fabricated using chemical lead supported by a steel cage. However lead has poor structural properties. It is too fragile to be prefabricated and shipped. Accordingly, the entire lead fabrication has to be done at the site of the construction by highly skilled lead burners. Such construction is expensive. It is also further complicated by the fact that the number of workers in the lead burner trade is rapidly decreasing.

To overcome the disadvantages of lead precipitators, the prior art has proposed that acid mist electrostatic precipitators be constructed from fiberglass reinforced plastic, since such plastic is corrosion resistant. However, such plastic material has a surface resistance of the order of $10^{12}$ ohms and to decrease this undesirably high surface resistance such precipitators have been provided with a continuous flow of liquid intended to provide a thin conductive film over the collecting surface area. However, it has been found to be very difficult to provide a film of wetting liquid uniformly over the total collecting surface. Small streams or rivulets develop leaving dry areas between wet areas and sparkover tends to occur at the boundary between the wet and dry areas. The rise in local temperature due to such sparkover usually results in the destruction of the plastic material. To repair such damage requires a major rebuilding. Attempts have been made to solve this problem by etching the surface of the collecting electrodes but this has not proved satisfactory.

It has also been proposed in the prior art to graphitize the inner surface of the collecting electrode tube or pipe but such conductive surface coatings are washed off in time and require recoatings to avoid destruction by sparkover.

Other proposed coating techniques include painting of the inner surface of the collecting pipe with a conductive varnish or with an epoxy base paint which contains metallic particles, but metallic particles tend to corrode and oxidize which decreases the conductivity, thereby defeating the purpose for which the metallic particles were provided.

The prior art has also proposed admixing graphite particles to fiberglass reinforced polyester resin in such quantity as to bring the surface resistance of the collector down to $10^4$ ohms.

SUMMARY OF THE INVENTION

A principal object of the present invention is to provide an improvement in electrostatic precipitators which are adapted for the removal or collection of particulate from corrosive and aggressive gases.

Another object is to provide a precipitator which is not only adapted for removing corrosive moisture or mist from a gas stream but is also adapted to dry collection, provided a wetting and/or flushing system is used.

DETAILED DESCRIPTION OF THE PREFERRED EMBODIMENTS

Figure 1:
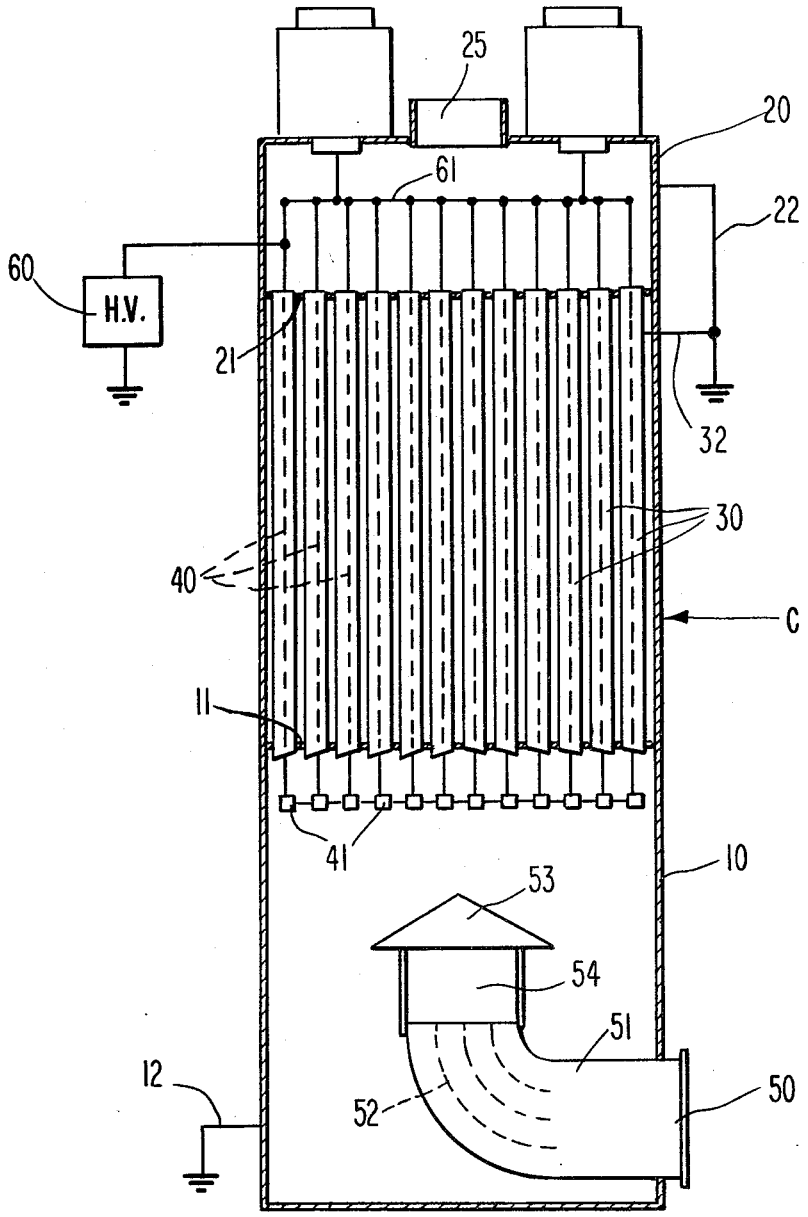
FIG. 1 is an elevational view, partly in section, of an electrostatic precipitator according to the present invention.

FIG. 1 illustrates an electrostatic precipitator according to the present invention. The precipitator comprises a housing or casing C having a lower portion 10 and an upper portion 20. Located in lower portion 10 is a lower header 11 having guide holes therein for passages and guidance of an array of collector tubes 30. There may, for example, be 21 collector tubes in the array. The upper ends of the collector tubes 30 are supported in an upper header 21 in the upper portion 20 of the casing. Upper header 21 also functions as a gas seal preventing the escape of gas except through the tube passages.

The acid mist gas is introduced into lower housing 10 at inlet 50. In order to distribute the gas substantially uniformly throughout the interior of the lower housing 10, the inlet pipe 51 is provided with three turning vanes 52 and with a hat 53 to direct the gas laterally outward through adjustable side openings 54. The gas is discharged from the precipitator through an outlet 25 in the upper housing.

Located on the vertical center axis of each of the tubular electrodes 30 is a corona discharge electrode 40 which is supported only at its upper end by known means located in upper shell 20. Each corona discharge electrode 40 is maintained on the center axis of its respective tube by a plumb weight 41 secured to the lower end of the electrode.

One terminal of a high voltage power supply 60 is connected to a lead wire 61 which is connected to the upper end of each of the corona discharge electrodes 40. The other terminal of the high voltage supply 60 is connected to ground. Also connected to ground, as by stainless steel grounding leads 12, 22 and 32, are, respectively, the lower housing 10, upper housing 20, and collector tubes 30. The illustration of these ground connections in FIG. 1 are merely schematic. The physical constructions of the ground connections will be described in more detail later.

Figure 2:
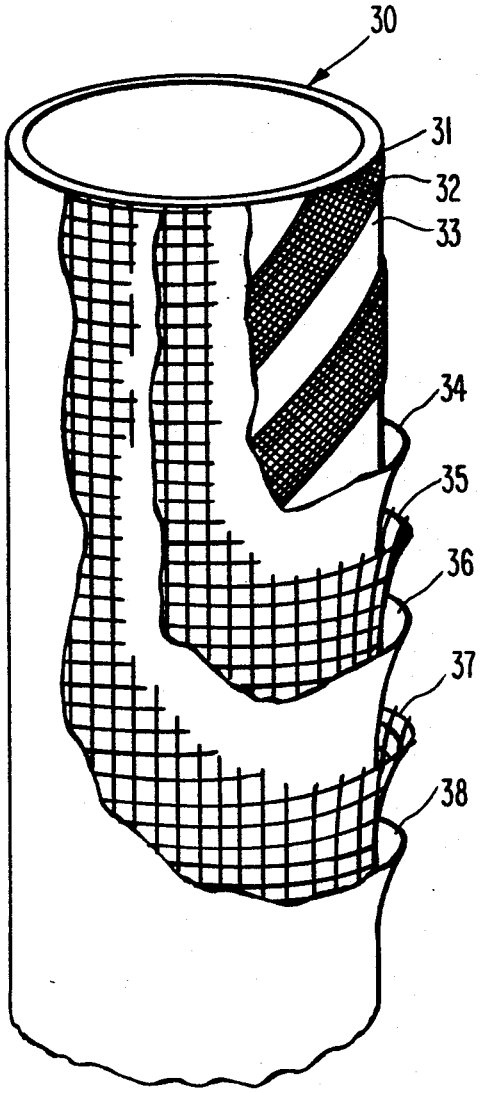
FIG. 2 is an enlarged fragmentary view, broken away, of a portion of the tubular collector electrode showing the various layers which make up the laminated wall of the collector tube.

Reference is now made to FIG. 2 which illustrates the laminated construction of the wall of the tubular collector electrodes 30, as proposed by the present invention. As seen in FIG. 2, the laminated construction of the tubular electrode wall comprises the following layers, in order from the inner layer outwardly: an interior surface; an interior layer; an exterior layer; an exterior surface.

The interior surface preferably comprises a first layer 31 of resin, preferably Hetron 197, and/or other high quality resin impregnated with graphite in an amount of 20–25 percent by weight and having a thickness of the order of at least 10 mils; a band 32 of steel wire cloth or mesh helically wound, said band preferably having a width of the order of 2 inches and helically wound on centers of the order of 6 inches; another layer 33 of resin, preferably Hetron 92, and/or other high quality resin impregnated with graphite and having a thickness of the order of at least 10 mils; and a fiberglass veil (not shown) having a thickness of the order of 10–20 mils.

The interior layer preferably comprises a fiberglass mat layer 34 of the order of 100 mils.

The exterior layer preferably comprises a fiberglass mat layer 36 sandwiched between two layers of fiberglass roving 35 and 37.

The exterior surface preferably comprises a fiberglass mat layer 38.

Figure 3:
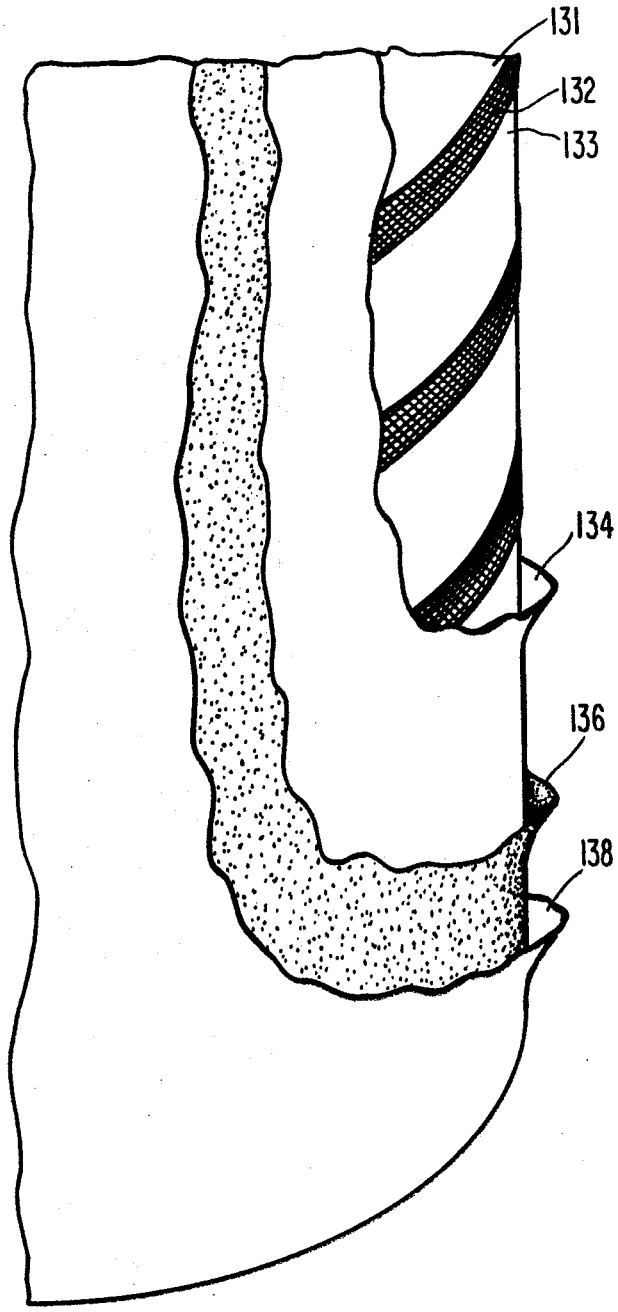
FIG. 3 is an enlarged fragmentary view, broken away, showing the various layers which make up the laminated wall of the housing or casing.

FIG. 3 illustrates the make-up of the laminate structure of the wall of the housing or casing C. The interior surface and interior layers are similar to those of the tubular collector electrodes 30, and are identified in FIG. 3 by similar reference numerals to which 100 has been added. However, the steel wire mesh 132 is helically wound on 12 inch centers as compared with 6 inch centers for mesh 32 of the collector tubes. The exterior layer 136 corresponds to layer 36 of FIG. 2 but is spray wound. The exterior surface 138 is similar to that of exterior surface 38 of FIG. 2.

The function of the steel mesh or wire cloths 32 and 132 of the collector tubes and casing is to provide a ground connection substantially uniformly throughout the entire area of the wall of the collector tubes and casing close to the inner surface. The mesh also provides some structural integrity. The wire cloths 32 and 132 of the tubes and casing are applied after the first layers 31 and 131 of graphite impregnated resin are applied and after it has cured. The mesh may be held down, as with tape, until it can be laminated into the backup resins 33 and 133, respectively.

Steel wire cloth is also applied to the bottom header 11 and to the top header 21. The wire cloth is preferably applied to the headers in flat strips which may preferably be approximately 2 feet long, with each strip overlapping the other. As in the case of the collector tube, the flat strips of wire cloth are applied after the first layer of graphite-impregnated resin has been applied and cured. The strips may be held down with tape until they can be laminated into the backup resin.

Each collector electrode tube 30 is provided with a grounding lug which may be stainless steel or lead and is connected to the steel wire mesh cloth 32 of the tubular electrode 30. A grounding lug is also connected to the steel mesh strips imbedded in the bottom header 11. The grounding lug is applied over the graphite impregnated resin of the inner surface 31 after the inner layer has cured. The ground lug is held in place by temporary means and the wire cloth 32 is laid over the edges of the lug. After this has been done, the backup resin 33 laminates the lug in place. A similar technique is used in connection with the flat strips of mesh in the header 11.

The advantages of the construction illustrated and described will now be discussed. The graphite impregnated resin surface 31 of the inner wall of the tubular collector electrode 30 and of the casing C each have a surface resistivity of the order of $10^6$ ohms. If a surface having such high resistivity were to be connected to ground only at the lower end of the tubular collector electrode 30, which may for example be 9 feet high, the impedance seen by the corona discharge electrode 40 would vary throughout the length of the discharge electrode, being greater at the upper end portion of the electrode 40 and lesser at the lower end portion. As a consequence, the corona discharge current would not be uniformly distributed throughout the length of the corona discharge electrodes 40. This is undesirable.

An important advantage of the construction of the present application is that the corona discharge electrode 40 looks at a substantially equal impedance to ground throughout the entire length of the corona discharge electrode, thereby producing substantially uniform corona current distribution throughout the entire length of the discharge electrode. Such uniform distribution is, of course, highly desirable for efficient collection of acid mist or other particles from the gas stream being passed upwardly through the tubular passages.

The admixture of graphite into the resin provides a relatively low resistance path between all points on the inner surface of the collector electrode tube 30 and the ground mesh 32. The impedance from the inner surface of the collector tube wall to the ground mesh is substantially smaller than the surface resistance of the interior surface of the tubular electrode. Moreover, this smaller impedance, as seen by the corona discharge electrode 40, is substantially uniformly distributed throughout the entire length of the discharge electrode and entire length of the tubular collecting electrode. The result is to produce a uniform distribution of corona discharge current throughout the entire length of the electrode tubes. As previously indicated, this is highly desirable for efficient collection of acid mist particulate, as well as the collection of other particulate.

It is to be particularly noted that in the precipitator of the present application the surface resistivity of the tubular collecting electrodes 30 ($10^6$ ohms) is made the same as the surface resistivity of the shell or housing or casing C. It has been discovered that the surface resistance properties of the collector tubes and of the housing or shell should be as nearly the same as possible. It has been discovered that if the surface resistivity of the housing or shell is substantially higher than the surface resistivity of the tubular collecting electrodes, static charges of the order of 4 kilovolts DC will accumulate on the housing surface. This is, of course, undesirable. The build-up of such static charges on the housing surface is avoided, in accordance with the teaching and design of the present application by making the surface resistance of the inner wall of the collector tube as high as that of the housing, and by embedding a helical ground metal-mesh band in the resin laminate structure.

The precipitator described in the present application may also be used for dry applications due to the fact that the graphite impregnated in the resin results in an appreciable increase in thermal conductivity so that any heat locally developed by sparkover is quickly dissipated, thereby avoiding destruction of the material due to sparkover.

It should be mentioned that a fire-retardant additive may preferably be included in the outer surface resin of both the collector anode and housing.

What is claimed is:

1. In an electrostatic precipitator:

a. a plurality of tubular collector electrodes each having a surface resistivity of the order of $10^6$ ohms, the wall of said collector electrodes being a laminate and comprising the following layers in order from the inner surface outward;

a-1 an interior surface layer comprising a conductive metal mesh interposed between inner and outer layers of resin impregnated with graphite and having a fiberglass veil;

a-2 an interior layer of fiberglass mat;

a-3 an exterior layer of fiberglass mat interposed between layers of fiberglass roving;

a-4 an exterior surface layer of fiberglass mat b. a casing having an interior surface layer similar to that of said tubular collector electrodes and having a surface resistivity substantially equal to the surface resistivity of the tubular collector electrodes; and c. means for grounding said mesh.

2. Apparatus according to claim 1 wherein said graphite is mixed into said resin in proportions of the order of 20–25 percent by weight.

3. Apparatus according to claim 1 wherein:

a. said metal mesh comprises a narrow band helically wound on centers at least several times greater that the width of said band.

4. Apparatus according to claim 3 wherein said metal mesh band has a width of the order of 2 inches and is wound helically in the wall of said collector tubes on approximately 6-inch centers.

5. Apparatus according to claim 3 wherein said metal mesh band has a width of the order of 2 inches and is helically wound in the wall of said casing on approximately 12-inch centers.

6. Apparatus according to claim 3 wherein said graphite is mixed into said resin in proportions of the order of 20–25 percent by weight.

7. Apparatus according to claim 3 wherein said inner and outer layers of graphite impregnated resin, between which said metal mesh is interposed, each have a thickness of the order of at least 10 mils.

8. Apparatus according to claim 7 wherein said interior layer of fiberglass mat has a thickness of the order of 100 mils.

9. Apparatus according to claim 8 wherein said fiberglass veil has a thickness of the order of 10–20 mils.

10. Apparatus according to claim 1 wherein said inner and outer layers of graphite impregnated resin, between which said metal mesh is interposed, each have a thickness of the order of at least 10 mil.

11. Apparatus according to claim 10 wherein said interior layer of fiberglass mat has a thickness of the order of 100 mils.

* * * * *